United States Patent [19]

Flodman

[11] Patent Number: 4,516,345

[45] Date of Patent: May 14, 1985

[54] CARTRIDGE EJECTOR DEVICE FOR FIREARMS

[75] Inventor: Rune Flodman, Nora, Sweden

[73] Assignee: Flodman Guns KB, Nora, Sweden

[21] Appl. No.: 503,137

[22] PCT Filed: Oct. 2, 1981

[86] PCT No.: PCT/SE81/00285

§ 371 Date: Jun. 1, 1983

§ 102(e) Date: Jun. 1, 1983

[87] PCT Pub. No.: WO83/01297

PCT Pub. Date: Apr. 14, 1983

[51] Int. Cl.[3] ..... F41C 15/00

[52] U.S. Cl. ..... 42/46; 42/47

[58] Field of Search ..... 42/25, 46, 47

[56] References Cited

U.S. PATENT DOCUMENTS 2,461,077 6/1953 Foote et al. ..... 42/43

3,964,198 6/1976 Waddell ..... 42/48

*Primary Examiner*—Charles T. Jordan

*Assistant Examiner*—Ted L. Parr

*Attorney, Agent, or Firm*—Hill, Van Santen, Steadman & Simpson

[57] ABSTRACT

Ejector device for a firearm, the action of which is opened by tilting about a hinge interconnecting the barrel and the receiver. A spring-urged cartridge ejector (19) is latched in cocked position by an ejector latch plunger (35) which is displaceable by the mechanical pressure exerted by the outer side of a fired cartridge to move from a non-latching inner position to an outer position latching the cartridge ejector (19). From the outer position, the plunger is moved back to the inner position by camming interaction of the outer plunger end (35*b*) and the receiver sidewall (15) upon tilting the firearm to fully open or substantially fully open the position of the action.

6 Claims, 7 Drawing Figures

CARTRIDGE EJECTOR DEVICE FOR FIREARMS

BACKGROUND OF THE INVENTION a. Field of the Invention

This invention relates to a cartridge ejector device for a firearm the action of which (the operating mechanism by which a gun is loaded, fired and unloaded) is opened by tilting about a hinge interconnecting the barrel and the receiver or receiver housing.

b. Prior Art

Ejector devices are used in particular in multi-barrel firearms and serve in response to opening of the action to extract (pull or push) a cartridge in the chamber rearwardly, either relatively slowly and only partially out of the chamber so that the cartridge can be grasped manually by the operator, or to rapidly and completely eject it out of the chamber so that the chamber becomes accessible for the insertion of a fresh cartridge. The slow extraction is desired in the case of an unfired cartridge, whereas the rapid ejection is desired in the case of a fired cartridge, that is, a cartridge shell.

The ejection of the cartridge is effected by a spring which is loaded by a cam on the receiver in response to closing of the action. When the slow extraction takes place, this cam controls the rearward movement of the cartridge ejector so that the cartridge ejector is moved at a rate corresponding to the rapidity at which the firearm action is opened. The rapid ejection is accomplished in that the ejector latch latches the cartridge ejector until the action has been fully or almost fully opened. When the ejector latch is then released and accordingly unlatches the cartridge ejector, the cartridge ejector is set free for unrestrained rearward movement under the influence of the spring force.

In a prior art cartridge ejector device, the gas pressure developed inside the barrel upon the firing is used to actuate the ejector latch to cause it to latch the cartridge ejector (U.S. Pat. No. 3,964,198). However, this prior art cartridge ejector device is complicated and delicate.

SUMMARY OF THE INVENTION

The invention relates to a cartridge ejector device comprising a spring device including a movable cartridge ejector, and an ejector latch serving to latch the cartridge ejector, the ejector latch being releasable in response to opening of the firearm action and including a sensing member which is actuatable through an opening in the barrel wall.

The object of the present invention is to provide a simple and reliably functioning cartridge ejector device of the above-indicated kind. To this end, in the ejector device according to the invention the sensing member is actuatable by the mechanical force exerted by the outer side of a fired cartridge to perform a movement for latching the cartridge ejector.

Whereas in the prior art device the gas pressure forwardly of the fired cartridge is transmitted through the opening in the barrel wall to effect displacement of the ejector latch through the intermediary of a piston mounted by the side of the barrel, the lateral expansion of the fired cartridge casing is made use of in the device according to the invention to effect the latching movement of the ejector latch. Owing to this fact, the ejector device according to the invention can be constructed with few and uncomplicated components and can function reliably.

In a particularly uncomplicated and reliable embodiment of the ejector device according to the invention, the sensing member and the ejector latch are united in a single element, namely, a plunger which is displaceable transversely of the direction of movement of the cartridge ejector and having an ejector arresting abutment which in response to the firing is moved into the path of movement on a projection of the cartridge ejector to latch the latter.

An exemplary embodiment of the ejector device according to the invention is described in greater detail hereinafter, reference being had to the accompanying drawings.

Figure 2:
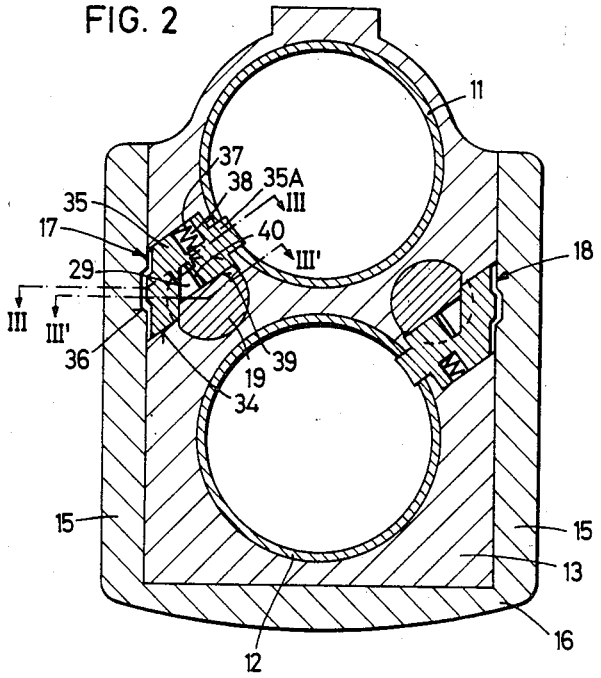
FIG. 2 is a cross-sectional view of the firearm action taken along line II—II of FIG. 1.
Figure 6:
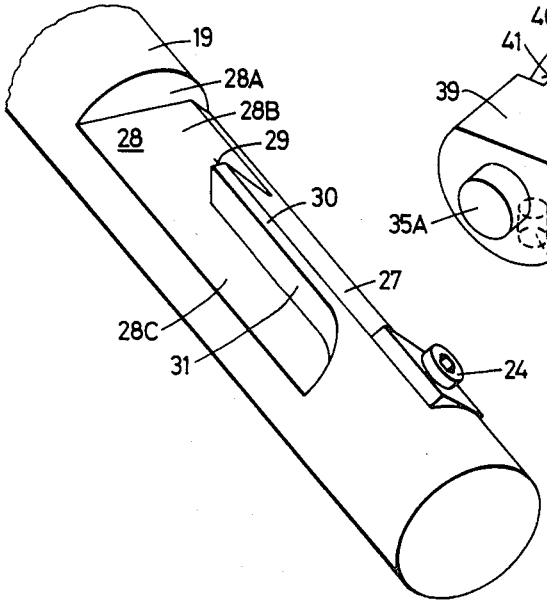
Figure 7:
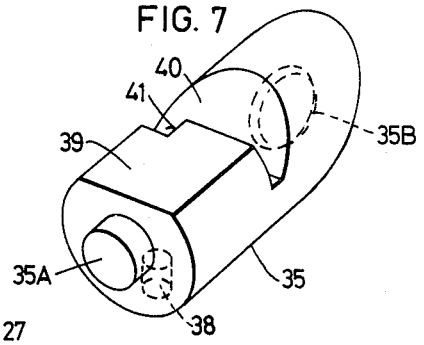

FIG. 6, appearing with FIG. 2, is a perspective view of a portion of the cartridge ejector, the size of certain details being slightly exaggerated for clarity; and FIG. 7, appearing with FIG. 2, is a perspective view of a plunger which constitutes both an ejector latch and a firing sensor.

As shown on the drawings:

The illustrated firearm is a double-barrelled shotgun the two barrels 11 and 12 of which are positioned one above the other and have their rear ends received in a common breech 13. A hinge pin 14 pivotally connects the breech to the front portion of the side walls 15 of a receiver 16. The butt (not shown) of the gun is secured to the rear portion of the receiver 16. The action of the gun can be opened in the conventional manner by tilting the barrels and the breech about the hinge pin 14 relative to the receiver and the butt so that the chambers provided in the rear portion of the breech are opened for loading and cartridge ejection. Except for the cartridge ejector system, the details of the action form no part of the invention and, therefore, are not shown.

Each barrel 11 and 12 has a cartridge ejector device 17 and 18, respectively, which is for the most part located in the breech but also comprises portions of the receiver side walls 15. As shown in FIG. 2 the cartridge ejector devices 17, 18 are positioned on opposite sides of the breech. For the sake of simplicity, the following description is directed in particular to one of the cartridge ejector devices, namely, the cartridge ejector device designated 17 and associated with the barrel 11, but this description is also valid for the other cartridge ejector device 18.

The cartridge ejector device 17 comprises a cartridge ejector 19 in the shape of a generally circular cylindrical rod which is axially displaceable in a bore 20 (FIG .3) formed in the breech and extending parallel to the barrel 11. This bore 20, which is open at the rear end face 21 of the breech, accommodates in front of the cartridge ejector 19 a compression spring 22 constantly urging the cartridge ejector rearwardly.

At its rear end the cartridge ejector 19 has an ejector lug 23 which in the loaded condition of the gun engages the rim of the cartridge in the chamber of the barrel 11 so as to cause the cartridge to move rearwardly with the cartridge ejector upon opening of the action.

Figure 3:
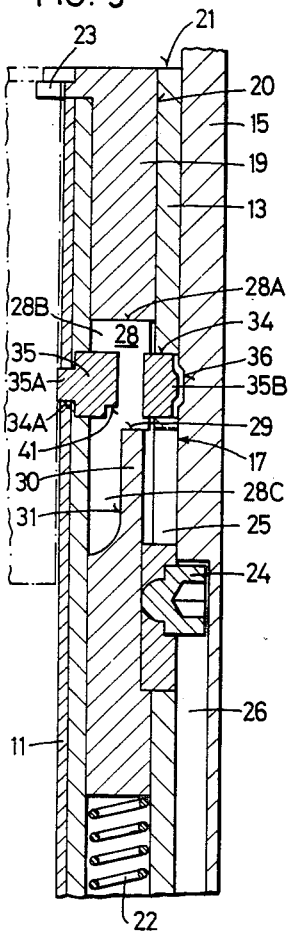
FIGS. 3, 4 and 5 are sectional views taken partly along line III—III and partly along line III'—III' of FIG. 2 and showing the ejector device in different positions.

Upon closing of the action the cartridge ejector 19 is to be moved to the advanced position shown in FIG. 3 against the influence of the spring 22. To this end, the front portion of the cartridge ejector is provided with a cam follower 24 projecting through a groove 25 in the breech 13 and engaging a cam groove 26 formed in the inner side of the adjacent receiver side wall 15. The closing movement causes the cam follower 24 to slide along one wall 26A (FIG. 1) of this cam groove 26 so that the cartridge ejector is gradually forced to move forwards from a retracted position, not shown, to the advanced position while compressing the spring 22.

Between its ends, the cartridge ejector 19 has a flat face 27 on the front portion of which the cam follower 24 is secured. A further flat face 28 includes an acute angle with the first-mentioned face and extends forwards from a transverse face 28A defining the rear end of the face 27. The face 28 comprises a rear portion 28B extending transversely across the cartridge ejector 19 and a front portion 28C extending only partially across the cartridge ejector.

At the transition between the front and rear face portions 28B, 28C the cartridge ejector 19 has a rearwardly facing shoulder 29 formed by the rear end of a ridge 30 having a substantially triangular cross-section. One flank of the ridge is formed by the first-mentioned flat face 27 and the other flank is formed by a face 31 perpendicular to the face 28.

Figure 4:
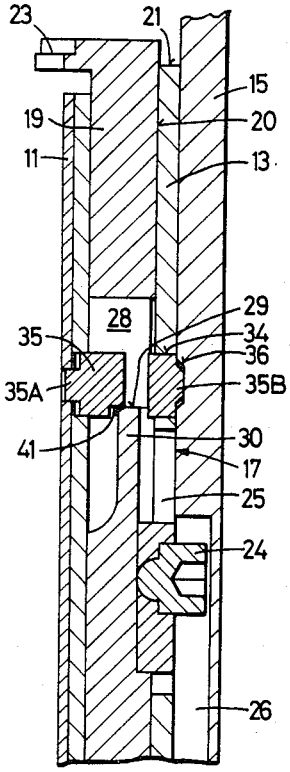
Figure 5:
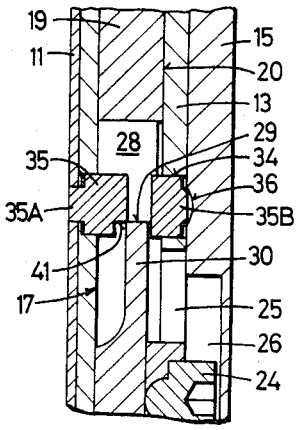

The cross-sections shown in FIGS. 3 to 5 are taken along line III'—III' in the areas located forwardly and rearwardly of the face 28.

The cartridge ejector device 17 also comprises a plunger 35 which is slidably accommodated in a bore 34 formed in the breech 13 and which serves both as an ejector latch and as a firing sensor member. The bore 34 intersects the cartridge ejector bore 20 at right angles and extends from the outer side of the breech to the vicinity of the barrel 11 where it merges with an opening 34A of smaller diameter provided in the wall of the barrel 11. Basically, the plunger 35 is generally cylindrical but as shown in FIG. 7 it has various recesses and other structural details. In FIG. 3 it is shown that the locations of the bore 34 and the plunger 35 are such that the shoulder 29 of the cartridge ejector 19 is spaced forwardly from the plunger when the cartridge ejector is in the advanced position.

The plunger 35 is displaceable between an inner position shown in FIG. 3 and an outer position shown in FIG. 4. In the inner position, a cylindrical inner end portion 35A of the plunger projects a few tenths of a millimeter into the bore of the barrel 11 through the opening 34A. In the outer position, the outer end 35B of the plunger projects slightly from the outer side of the breech 13 and engages an arcuate groove 36 formed on the inner side of the receiver side wall 15 (see also FIG. 1).

A compression spring 37 is received in a blind bore 38 formed on one side of the plunger 35. This spring 37 serves to urge the plunger against the wall of the bore 34 to render the plunger stiffly movable in the bore. The friction between the plunger and the wall of the bore is sufficient to retain the plunger in position so that accidental displacement of the plunger is prevented. Thus, in order that the plunger may be displaced in the bore, it has to be acted on by a force sufficiently strong to overcome the friction, to eliminate the risk of uncontrolled displacement of the plunger.

Near its inner end the plunger 35 is provided with a flat face 39 which is turned to and positioned adjacent, or in slidable engagement with, the rear portion 28B of the flat face 28 of the cartridge ejector 19. Hence, the cartridge ejector 19 prevents rotation of the plunger within the bore 34.

The flat face 39 merges with a transverse recess 40, the cross-sectional shape of which roughly matches that of the cartridge ejector ridge 30. In FIGS. 3 and 4 it is shown that this recess is located such that the ridge 30 can enter and pass through it when the plunger is in its inner position, while in its outer position the plunger prevents the ridge from moving past the adjacent side of the plunger. Adjacent the inner side of the recess 40, i.e., the side closest to the barrel, the plunger is provided with a forwardly facing flat face 41 forming an arresting abutment for the shoulder 29 at the rear end of the ridge 30 and thus for the cartridge ejector 19.

Figure 1:
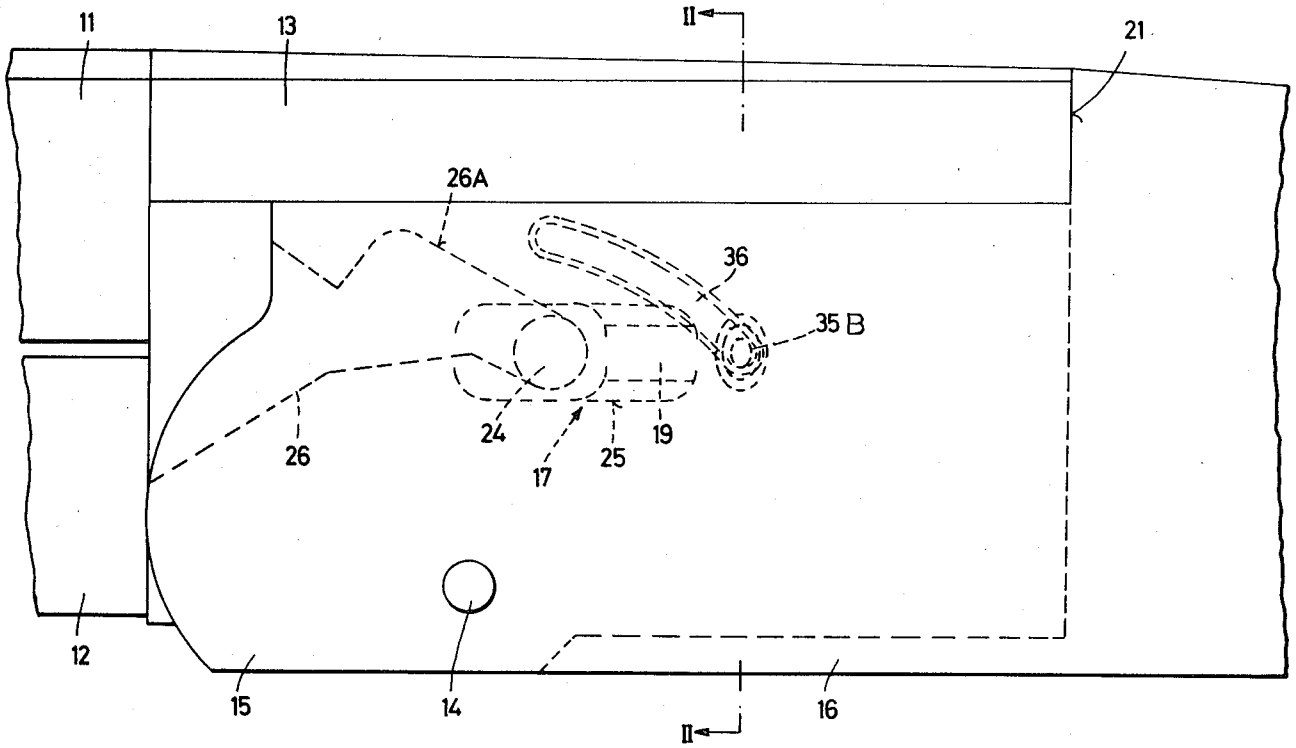
FIG. 1 is a side view of that portion of a firearm having the cartridge ejector device of the invention which includes the action of the firearm.

When the firearm is ready for firing a cartridge loaded into the barrel 11, the ejector device is in the position shown in FIGS. 1 to 3 with the cartridge ejector 19 held in the advanced position by the wall 26A of the camming groove 26 of the receiver side wall 15. Upon firing, the cartridge shell (which is indicated in phantom lines in FIG. 3) will be expanded radially by the gas pressure developed by the burning powder and will thus push the plunger 35 to the outer position shown in FIG. 4.

If the action of the gun is then tilted open, the cartridge ejector 19 will initially move rearwardly a short distance, namely, until it is arrested as a consequence of engagement of the shoulder 29 of the cartridge ejector ridge 30 with the arresting abutment 41 of the plunger 35. This rearward movement of the cartridge ejector 19, which results in the cartridge shell being retracted through a corresponding distance, takes place partly through the action of the wall of the cam groove 26 and partly through the influence of the compressed spring 22.

During the continued tilting movement the outer plunger end 35B slides, without being acted on, along the arcuate groove 36 on the inner receiver side wall until it approaches the end of the groove. The terminal portion of the bottom of the groove acts as a camming surface which coacts with the plunger end 35B to displace the plunger 35 to its inner position when the tilting movement is completed and the action thus is fully opened. FIG. 5 shows the positions of the parts the moment before the plunger reaches its inner position and goes out of its latching engagement with the cartridge ejector 19. When the plunger reaches the inner position, the cartridge ejector is set free to move rearwardly to the retracted position under the influence of the force of the spring 22 to eject the cartridge (cartridge shell) from the chamber. The cartridge ejector 19 is arrested in the retracted position as a consequence of engagement of the cam follower 24 with the cam groove wall 26A.

If the action of the gun is tilted open before the cartridge is fired, the cartridge ejector 19 is free to be continuously moved, without being obstructed by the plunger, to the retracted position at a speed corresponding to the rapidity at which the tilting takes place. The cartridge then is not ejected by only retracted sufficiently to enable the operator to comfortably grasp it by the fingers and remove it.

When constructed as described above, the cartridge ejector device not only is uncomplicated and reliably functioning, but can also be easily assembled and disassembled. Disassembly can be accomplished after the breech 13 with the barrels 11 and 12 has been removed from the receiver. The plunger can then readily be removed after the cartridge ejector 19 has been pushed to the advanced position, whereupon the cartridge ejector 19 and the spring 22 can readily be removed.

I claim:

1. In a firearm having a barrel secured to a breech and a receiver interconnected by a hinge for enabling relative pivotal movement to open the action thereof, and means for ejecting a cartridge in response to such opening pivotal movement, said means comprising:

(a) a cartridge ejector slideably mounted in said breech for movement paralllel to said barrel between a fully advanced position and a retracted position, and biased by a spring toward said retracted position, said ejector having a shoulder extending transversely to the direction of ejector movement; and (b) A combined latch and sensing member slideably mounted in a bore in said breech for movement transverse to that of said ejector between a non-latching inner position and a latching outer position, said member having a portion for latching said ejector adjacent to its said fully advanced position, said member being responsive to said opening pivotal movement to unlatch said ejector, said member having a sensing plunger extending through an opening in the wall of said barrel an actuatable in response to mechanical force exerted by the expanding shell of a fired cartridge for movement of said member to said ejector-latching outer position, and said member having an ejector-arresting abutment which, in said outer position, is in the path of said shoulder during initial movement of said ejector from said fully advanced position.

2. A device according to claim 1, said member extending from the inner surface of said barrel, through said breech and into a cam groove in said receiver, said member being displaceable from said outer position to said inner position in response to completed pivotal opening of the firearm action.

3. A device according to claim 2, said member having a substantial friction with said breech to normally retain it in each of said positions, said ejector having a longitudinally extending face slidably engaging said member and holding said member against rotation.

4. A device according to claim 1, said member being displaceable away from said barrel to said outer position when said ejector is in said fully advanced position.

5. A device according to claim 2, said member being displaceable away from said barrel to said outer position when said ejector is in said fully advanced position.

6. A device according to claim 3, said member being displaceable away from said barrel to said outer position when said ejector is in said fully advanced position.

* * * * *